US006149077A

United States Patent [19]

Pohler

[11] Patent Number: 6,149,077

[45] Date of Patent: Nov. 21, 2000

[54] APPARATUS FOR DISPENSING A SPRAYABLE PRODUCT FROM AN AEROSOL CONTAINER

[75] Inventor: Andreas Pohler, Nauheim, Germany

[73] Assignee: Wellla Aktiengesellschaft, Darmstadt, Germany

[21] Appl. No.: 09/454,121

[22] Filed: Dec. 3, 1999

[30] Foreign Application Priority Data

Feb. 3, 1999 [DE] Germany ..... 199 04 361

[51] Int. Cl.[7] ..... B05B 1/14; B05B 11/00

[52] U.S. Cl. ..... 239/337; 239/447; 239/579

[58] Field of Search ..... 239/302, 337, 239/436, 443, 444, 446, 447, 563, 579; 222/402.17

[56] References Cited

U.S. PATENT DOCUMENTS

| | | | |
|---|---|---|---|
| 3,406,913 | 10/1968 | Frangos | 239/337 X |
| 3,628,733 | 12/1971 | Kahn | 239/337 |
| 4,257,560 | 3/1981 | Diamond | 239/337 |
| 5,735,465 | 4/1998 | Laforcade | 239/337 |

FOREIGN PATENT DOCUMENTS

| | | |
|---|---|---|
| 1 260 616 | 1/1972 | United Kingdom . |
| 93/23174 | 11/1993 | WIPO . |

*Primary Examiner*—Lesley D. Morris
*Attorney, Agent, or Firm*—Michael J. Striker

[57] ABSTRACT

The apparatus (1) for dispensing a sprayable product from an aerosol container includes a tube section (5) axially slidably mounted in a spray head (5). The spray head (3) has a feed passage (15), a connecting passage (14) and two nozzles (10,11 ) provided one above the other in the operating direction of the spray head (3), preferably oriented at an angle of 12° to each other. By depressing the spray head the tube section (3) is moved downward in order to open a valve (7) in the aerosol container (2), whereby product can travel from the aerosol container (2) into the spray head (3) and from there into only the lower nozzle (1). By subsequently depressing the spray head (3) further downward against the force of a spring (6) the connecting passage (14) is moved upward relative to the spray head (3) in order to connect both nozzles (10, 11) with the feed passage (15). In that way either a single spray stream or two overlapping spray streams can be produced according to choice.

8 Claims, 3 Drawing Sheets

APPARATUS FOR DISPENSING A SPRAYABLE PRODUCT FROM AN AEROSOL CONTAINER

BACKGROUND OF THE INVENTION

1. Field of the Invention

The present invention relates to an apparatus for dispensing a sprayable product, e.g. a hair spray, from an aerosol container, comprising a spray head and an axially slidable tube section mounted in a housing of the spray head, a first spring urging the tube section away from the housing and in an operating direction of the spray head, a valve inside the aerosol container, which has a second spring that is provided for urging the pipe section toward the spray head, two nozzles arranged in succession in the operating direction and respective feed ducts for the nozzles that are connectable with the tube section by means of a feed passage.

2. Prior Art

An apparatus of this type is described in U.S. Pat. No. 4,257,560 with which a conical spray with a comparatively wide spray angle or a conical spray with a comparatively small spray angle can be produced. In an initial position the valve is closed and a feed duct connects the tube section with a lower nozzle which has a comparatively large diameter. If the spray head is pushed downward, a lower spring is compressed, a valve opening of the aerosol container is opened and product in the aerosol container is fed through the tube section, the feed duct and the feed passage to the lower nozzle so that a comparatively wider conical spray is produced. By depressing the spray head further downward an upper spring is compressed, the feed passage in the spray head is pushed upward and a conical spray is fed only through the upper feed duct to an upper nozzle of comparatively small diameter aligned parallel to the lower nozzle with the lower feed duct closed, whereby a comparatively smaller conical spray is produced. In this way according to choice either a wider or smaller conical spray can be produced according to the extent the spray head is depressed.

GB 1260616 discloses that it is known to supply two equal parallel nozzles at the same time with sprayable product in order to produce a spray with an oval cross-section by overlapping two conical sprays.

No simultaneous operation of both nozzles is possible in the apparatus disclosed in U.S. Pat. No. 4,257,560, so that no overlapping conical sprays are produced in order to attain an approximately oval cross-section for a dispensed product.

However in the apparatus disclosed in GB 1260616, in contrast, it is not possible to produce a single conical spray.

SUMMARY OF THE INVENTION

It is an object of the present invention to provide an apparatus for dispensing a product contained in an aerosol container of the above-described type in which either a single conical spray or two overlapping conical sprays may be produced according to choice.

This object and others which will be made more apparent hereinafter are attained in an apparatus according to the invention for dispensing a sprayable product from an aerosol container comprises a spray head having a housing; a tube section arranged in the spray head and slidable axially relative to the housing; a first spring arranged in the spray head to urge the tube section in an operating direction of the spray head and relative to the housing; a valve arranged within the aerosol container and including a second spring arranged to urge the tube section back toward the housing and into the spray head; two nozzles provided one above the other in the operating direction of the spray head and respective feed ducts for the two nozzles provided in the housing connected with the two nozzles, the feed ducts being connectable with the tube section by means of a feed passage.

According to the invention the tube section is provided with a connecting passage for connecting the tube section either with only one of the feed ducts or with both feed ducts by sliding the tube section relative to the spray head, whereby only one nozzle or both nozzles are supplied with sprayable material according to choice.

Either a single conical spray or two overlapping conical sprays can be produced according to choice with the apparatus according to the invention. With the aerosol container valve open by pressing the tube section downward the connecting passage provides a connection either with only a first feed duct or both feed ducts according to choice. According to the properties of the desired spray first only one feed duct can be connected with the valve and subsequently also the second can be connected in order to first make a smaller spray pattern and subsequently a wider spray pattern. Alternatively immediately after the valve is opened both feed ducts are connected with the valve, and on further depressing the spray head, the connecting passage is moved upward from the lower connecting duct so that only the upper nozzle is provided with product in order to first produce a wider spray pattern and then a smaller spray pattern. A wider spray stream is used with hair sprays in order to spray a comparatively large area of the hair. A smaller spray stream is also used to spray only a comparatively small hair region, e.g. a strand, in order to provide a special fixing effect.

Further improvements are provided by various preferred embodiments of the apparatus according to the invention.

In one preferred embodiment of the apparatus the connecting passage is provided in a particularly simple manner when it is an annular cavity provided in an outer peripheral region of the pipe section, whose extent in the operating direction is larger or equal to a spacing of the feed ducts for the nozzles from each other. The annular nature of the connecting duct provide a satisfactory operation of the apparatus independently of the rotational position of the tube section and thus the position of the inlet of the pipe section in the valve. This simplifies its assembly.

If the nozzles are aligned or oriented at a non-zero angle to each other, a predetermined spray stream width can be provided by selecting this angle. An angle between 6° and 20° has proven beneficial to obtain a comparatively uniform wide spray pattern . An optimum spray pattern is provided when the angle between the nozzles is 12° or about 12°. In that case an easy-to-handle approximately elliptical spray cone cross-section is produced.

If the second spring is weaker than the first spring, the valve is first opened in a simple manner and without additional means during spray head operation and then a predetermined spray pattern may be selected and produced.

Equal nozzles have the advantage that the preparation of only one type of nozzle is required to make the apparatus.

A sealing element sealing the tube section is provided between the tube section and the first spring, which has a groove on its tube section side that extends through the sealing element and operates as a feed passage, so that a connection is provided between the interior of the tube section and the connecting passage in a simple manner and without additional structural elements. The sealing element seals in a suitable position between the connecting passage and principally to the first spring.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE PREFERRED EMBODIMENTS

Figure 1:
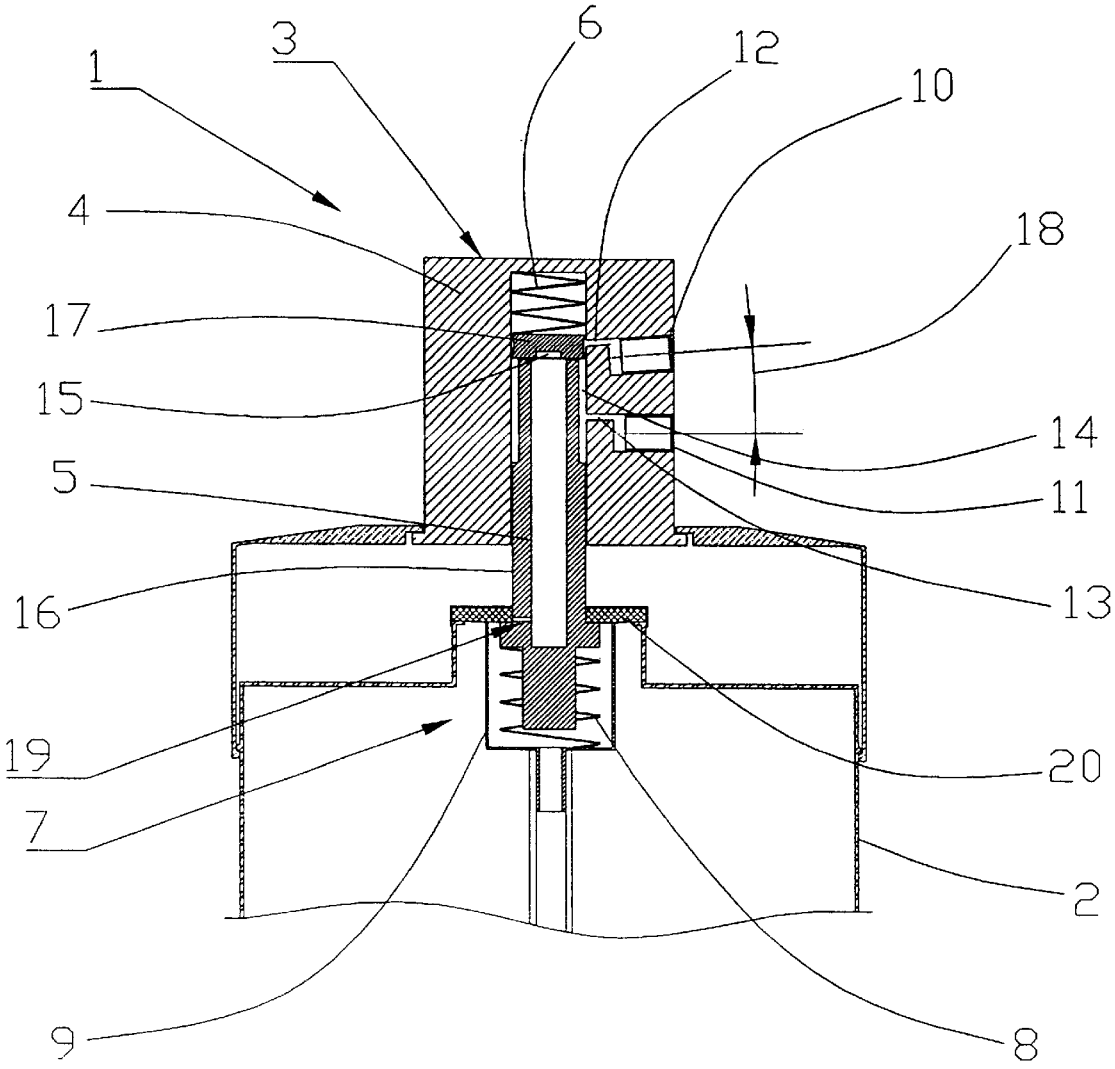
FIG. 1 is a vertical cross-sectional view through an apparatus for dispensing a sprayable product from an aerosol container with a depressable spray head, which can lower a tube section while compressing a lower spring in order to dispense product from the aerosol container by means of a lower nozzle, and, after further lowering of the spray head and the tube section, and after compressing an upper comparatively stronger spring, product is simultaneously s dispensed from both the lower and the upper nozzle, in a state in which a valve of the aersol container is closed.
Figure 2:
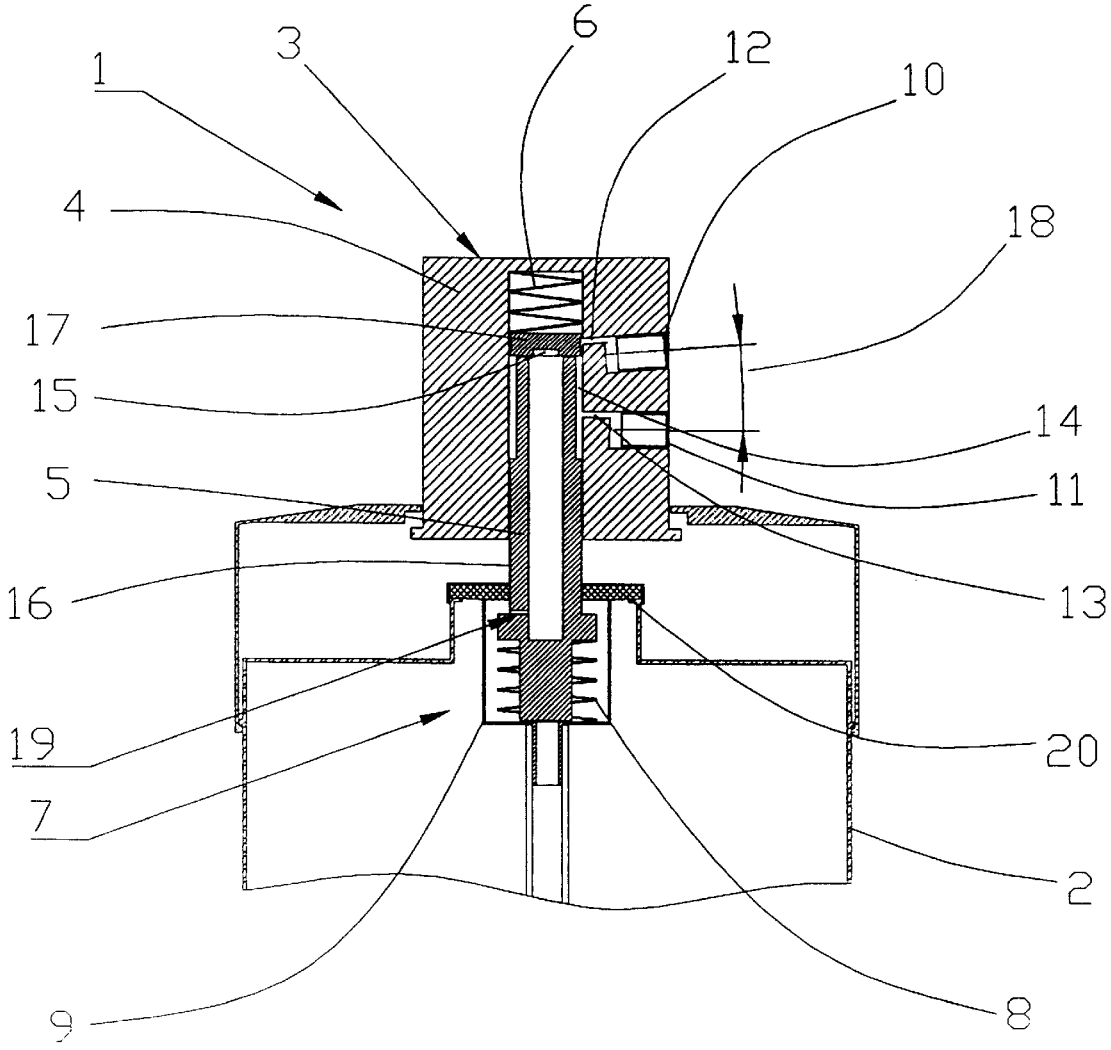
FIG. 2 is a vertical cross-sectional view through the apparatus of FIG. 1, however with a somewhat lowered spray head and open valve, so that product can be dispensed from the lower nozzle.

An apparatus 1 for dispensing a sprayable product from an aerosol container 2 comprises a spray head 3 and a tube section 5 axially slidable in a housing 4 of the spray head 3 (FIG. 1). The tube section 5 is slidable relative to the housing 4 and in the operating direction of the spray head 3 by means of a first upper spring 6 in the spray head 3. A valve 7 within the aerosol container 2 has a second spring 8, which is weaker than the first spring 6, which is braced on the valve housing 9, and which presses the tube section upward. Two nozzles 10, 11 located one above the other are provided with respective feed ducts 12,13. The feed ducts 12, 13 are again connected or connectable with the interior space in the tube section 5 by means of a connecting passage 14 and a feed conduit 15. The connecting passage 14 is connectable with only one feed duct 13 or simultaneously with both feed ducts 12,13 according to choice by sliding the tube section 5 relative to the spray head 3, in order to provide or open only one nozzle 11 or both nozzles 10,11.

The connecting passage 14 is an annular cavity in the outer peripheral region 16 of the tube section 5, whose extent in the operating direction is slightly greater than the spacing of the feed ducts 12,13 from each other.

A sealing element 17 sealing the tube section 5 and the connecting passage 14 is provided between the tube section 5 and the first spring 6, which has a groove acting as feed passage 15 and passing or extending through the sealing element 17 on its side facing the tube section 5.

The nozzles 10,11 are of the same type or are the same. These nozzles 10,11 are aligned at an angle 18 to each other, which is equal to about 12° or equal to 12°.

The valve 7 is closed in the initial position (FIG. 1). A valve opening 19 is closed by an annular seal 20 and the connecting passage 14 is only connected with the lower feed duct 13.

If the spray head 3 is pressed somewhat lower, as a result of the stronger structure of the upper spring 6 only the lower spring 8 is compressed, and the upper spring 6 remains in its extended stage. Thus the valve 7 is open and the connecting passage 14 remains in its original position relative to the spray head 3. Product in the aerosol container 2 passes through the valve opening 19, the tube section 5, the feed passage 15, the connecting passage 14 and the lower feed duct 13 to the nozzle 11 and is sprayed from there in the form of a conical spray which is not shown and which has a horizontal axis.

Figure 3:
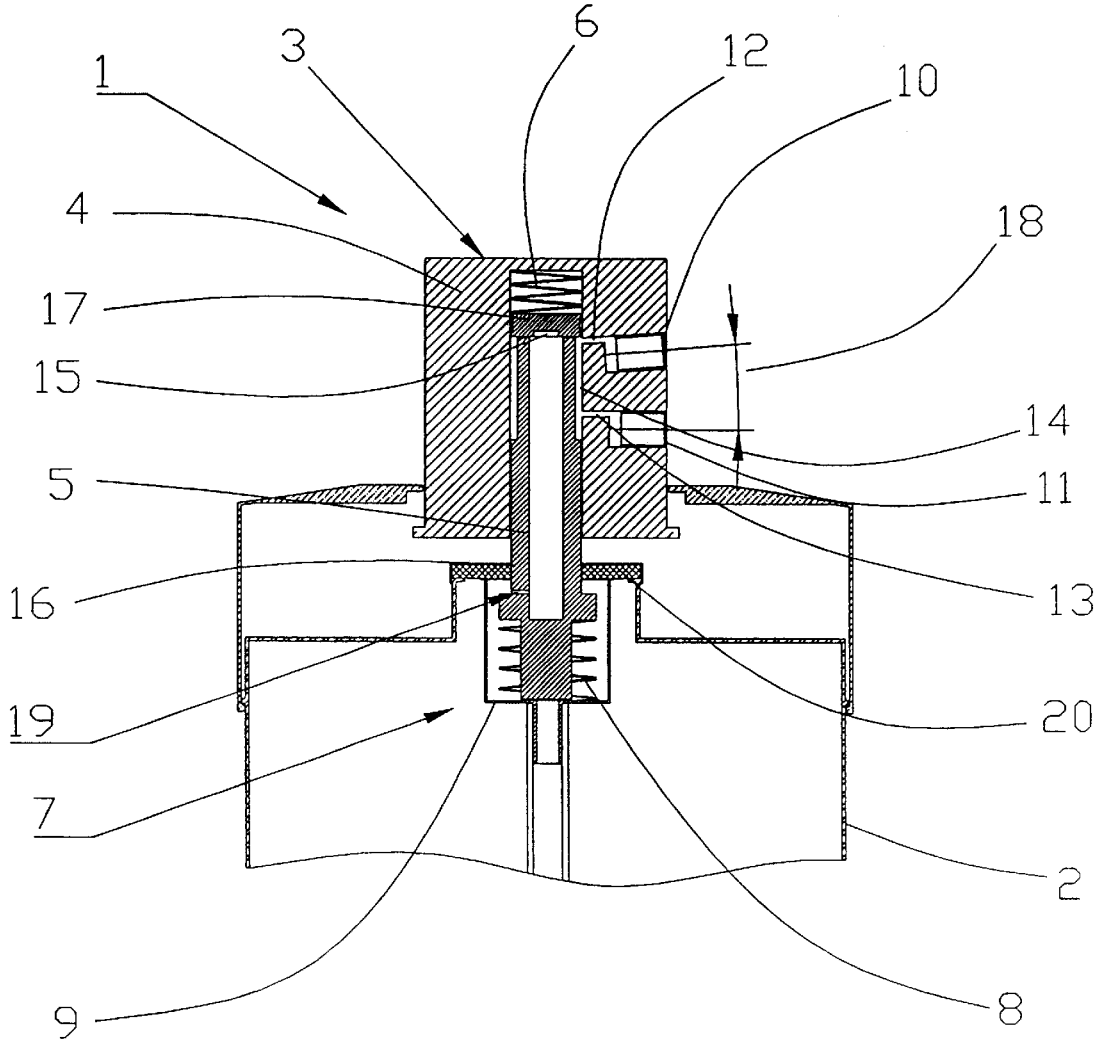
FIG. 3 is a vertical cross-sectional view through the apparatus shown in FIG. 2, however with a still further lowered spray head, so that an annular connecting passage in the upper region of the tube section allows product to be dispensed from both nozzles.

An equal conical spray however directed upward about 12° relative to the horizontal, which overlaps with the lower conical spray to form a relatively wide combined spray, can be formed by pressing the spray head 3 (FIG. 3) further down. During the further depression of the spray head 3 the lower spring 8 remains in its compressed state, and the upper spring 6 is also compressed until finally the connecting passage 14 connects the feed ducts 12, 13 with each other so that product is simultaneously dispensed from both nozzles 10,11.

While the invention has been illustrated and described as embodied in an apparatus for dispensing a sprayable product from an aerosol container, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. An apparatus for dispensing a sprayable product from an aerosol container, said apparatus comprising a spray head (3) having a housing (4);

a tube section (5) arranged in the spray head (3) and slidable axially relative to the housing (4);

a first spring (6) arranged in the spray head (3) to urge the tube section (5) in an operating direction of the spray head (3) relative to the housing (4);

a valve (7) arranged within the aersol container and including a second spring (9) arranged to urge the tube section (5) back toward the housing (4) and into the spray head (3);

two nozzles (10,11) provided one above the other in the operating direction of the spray head (3); and respective feed ducts (12,13) for said two nozzles provided in said housing (4) of said spray head and connected with said two nozzles, said feed ducts being connectable with said tube section (5) by means of a feed passage (15);

wherein said tube section (5) is provided with a connecting passage (14) for connecting the tube section (5) either with only one (13) of the feed ducts or with both of said feed ducts (12,13) by sliding said tube section (5) relative to said spray head (3), whereby only one of said two nozzles or both of said two nozzles (10,11) are supplied with sprayable material according to choice.

2. The apparatus as defined in claim 1, wherein said connecting passage (14) is an annular cavity provided in an outer peripheral region (16) of the tube section (5) and said connecting passage (14) has an extent in the operating direction that is greater or equal to a spacing of the feed ducts (12,13) from each other.

3. The apparatus as defined in claim 1, wherein said two nozzles are aligned or oriented at a non-zero angle (18) to each other.

4. The apparatus as defined in claim 3, wherein said non-zero angle is from 60 to 20°.

5. The apparatus as defined in claim 3, wherein said non-zero angle is 12°.

6. The apparatus as defined in claim 1, wherein said second spring (8) is weaker than said first spring (6).

7. The apparatus as defined in claim 1, wherein said two nozzles are equal or the same.

8. The apparatus as defined in claim 1, wherein a sealing element (17) for sealing the tube section (5) and the connecting passage (14) is provided between the tube section (5) and the first spring (6) and said sealing element (17) is provided with a groove acting as a conduit through the sealing element (17) and said feed passage (15) consisting of said groove.

* * * * *